United States Patent [19]

Urushibata et al.

[11] Patent Number: 4,963,699

[45] Date of Patent: Oct. 16, 1990

[54] APPARATUS FOR CONNECTING SETS OF ELECTRIC WIRES TO LEAD WIRES

[75] Inventors: Kenichi Urushibata; Keiichi Kojima; Kiyoto Sugawara; Haruo Saen, all of Tochigi, Japan

[73] Assignee: Sumitomo Electric Industries, Ltd., Osaka, Japan

[21] Appl. No.: 334,369

[22] Filed: Apr. 7, 1989

[30] Foreign Application Priority Data

Apr. 12, 1988 [JP] Japan ..... 63-89782
May 24, 1988 [JP] Japan ..... 63-126450

[51] Int. Cl.[5] ..... H01R 11/01

[52] U.S. Cl. ..... 174/88 R; 174/72 A; 174/94 R; 439/59; 439/741; 439/867; 439/882

[58] Field of Search ..... 174/88 R, 94 R, 72 A; 439/59, 81, 83, 629, 741, 865, 867, 876, 877, 882

[56] References Cited

U.S. PATENT DOCUMENTS

| | | | |
|---|---|---|---|
| 2,534,881 | 12/1950 | Schroeder | 174/84 S |
| 3,030,694 | 4/1962 | Kerstetter et al. | 439/865 |
| 3,051,773 | 8/1962 | Batcheller | 439/877 |
| 3,129,995 | 4/1964 | Brown | 174/88 R |
| 3,425,030 | 1/1969 | Hadden | 439/877 X |
| 3,546,663 | 12/1970 | Holmberg, Jr. | 439/867 X |
| 3,622,955 | 11/1971 | Fernex | 439/867 X |
| 3,715,457 | 2/1973 | Teagno et al. | 174/88 R |
| 3,729,701 | 4/1973 | Smith | 439/867 X |
| 3,861,775 | 1/1975 | Makins | 439/59 |
| 3,944,719 | 3/1976 | Rubey | 174/72 A |
| 4,263,474 | 4/1981 | Tennant | 174/88 R |
| 4,494,520 | 1/1985 | Hurivitz | 174/72 A |
| 4,714,801 | 12/1987 | Koblitz et al. | 174/88 R |

FOREIGN PATENT DOCUMENTS

| | | | |
|---|---|---|---|
| 796532 | 6/1958 | United Kingdom | 174/72 A |
| 1168935 | 10/1969 | United Kingdom | 439/629 |
| 2041256 | 12/1979 | United Kingdom | 174/72 A |
| 2033169 | 5/1980 | United Kingdom | 174/72 A |

*Primary Examiner*—Morris H. Nimmo
*Attorney, Agent, or Firm*—Cushman, Darby & Cushman

[57] ABSTRACT

An apparatus for joining a plurality of lead wires with a corresponding plurality of flat type electric wires. The apparatus comprises a plurality of connector terminals, each having a first caulking portion for securing the round wire to a first end of the connector terminal, and a clasping portion for securing the flat wire to a second end of the connector terminal, the clasping portion comprising a first and second spring portion, a projecting portion projecting from the clasping portion toward the flat wire, and second caulking portion for compressing the flat electric wire between the first and second spring portion by securing the first spring portion to the second spring portion. The projecting portion may receive solder so that the flat type electric wire can be spot welded to the connector terminal. To prevent short circuits between the connector terminals, a comb-like spacer may separate the connector terminals, or the exterior of each connector terminal may be insulated. The connector terminals may be encased in resin or the like to provide further protection from exposure. The resulting connection is extremely compact, reliable, and provides a stable electrical connection over time.

20 Claims, 2 Drawing Sheets

APPARATUS FOR CONNECTING SETS OF ELECTRIC WIRES TO LEAD WIRES

BACKGROUND OF THE INVENTION

The present invention relates to a connector terminal for connecting a plurality of lead wires to a corresponding plurality of flat type electric wires (e.g., connecting a lead wire to a flat conductor) for use in internal wiring such as home, industrial or car equipment.

Conventionally, a flat type electric wire having a rectangular conductor has been joined with a lead wire either by directly soldering the wires to a printed circuit board or by connecting the wires to individual connectors respectively, and mounting the connectors onto a printed circuit board.

Such conventional wire joining techniques, however, have various problems. When a printed circuit board is used, the space for the joint portion cannot be reduced to a small size, making this joining technique unsuitable for small and highdensity mounting. Soldering is necessary even when connectors are used. Accordingly, there is difficulty in maintaining sufficient reliability in electric stability and maintaining mechanical strength over a long time, particularly in the case where the joining technique is used for cars. Further, if the connection is made by directly soldering the wires to the printed circuit board, the connection may deteriorate due to moisture, heat resistance, etc., resulting in reliability problems.

SUMMARY OF THE INVENTION

It is therefore an object of the present invention to solve the problems in the prior art as described above. The present invention provides a connector terminal for connecting flat type electric wires with lead wires, composed of round type electric wires (hereinafter simply referred to as "lead wires"), particularly suited for places where the space available is small. The connector terminal requires no soldering work, and yet is capable of maintaining sufficient reliability, electric stability and mechanical strength for a long time. The present invention also includes a comb-like spacer made of an insulator for preventing short circuits between adjacent connector terminals, and in which the connection of each connector terminal is coated with resin so as to be solidified through a molding method or a filling method.

In order to attain the above object, the present invention provides a plurality of connector terminals, each connector terminal including: a crimpable portion formed at a first end of the connector terminal for fixing a round conductor of a lead wire by pressing with, for example, a crimping tool; two spring portions formed at a second end of the connector terminal for sandwiching (e.g., compressing) a rectangular conductor of the flat type electric wire between the two spring portions; a spring-portion crimpable portion formed on one of the two spring portions for caulking the other springs portion and the rectangular conductor; and a projecting portion formed on at least one of the two spring portions for making spot-welding with the rectangular conductor. The rectangular conductor of the flat type electric wire is sandwiched between the two spring portions, and the spring portions and a coated portion of the flat type electric wire lying therebetween are crimped together by the spring-portion caulking portion so as to fix the rectangular conductor between the spring portions. The projecting portion is then spot-welded on an exposed portion of the rectangular conductor. The conductor terminals are arranged side by side and are then fit into respective recess portions formed among teeth of a comb-like spacer made of an insulator; alternatively, the connector terminals have their outside surface portions coated with an insulator, except for surface portions contacting with the round conductors and the rectangular wires. The connector terminals arranged side by side, the insulating coatings of the lead wires and the flat type electric wire are then covered with resin through a molding or a filling process, thus solidifying the portion covered with the resin in the form of, for example, a box.

DETAILED DESCRIPTION OF THE PREFERRED EMBODIMENT

Figure 1A:
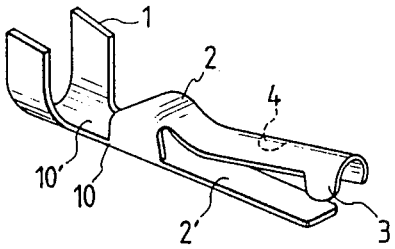
FIG. 1A is a perspective view showing a connector terminal used in the present invention.

Referring to the drawings, embodiments of the connector terminal according to the present invention will be described.

Figure 1B:
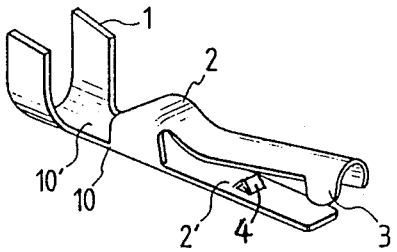
FIG. 1B is a perspective view of a variation of the connector terminal shown in FIG. 1A.

FIG. 1A is a perspective view showing an embodiment of the connector terminal according to the present invention. Connector terminal 10 comprises round conductor crimpable portion 1 for crimping a round type electric wire (hereinafter a "lead wire"). Spring portions 2 and 2' sandwich a flat conductor from its upper and lower sides. Spring portion crimpable portion 3 is provided for crimping portions 2 and 2' so that spring portions 2 and 2' sandwich the rectangular conductor. A projecting portion 4 is provided at a substantially central portion of the spring portion 2 as shown in FIG. 1A, or alternately on spring portion 2', as shown in FIG. 1B. Alternately, connector terminal 10 may include base portion 10, to which round conductor crimpable portion 1 and spring portion 2 are attached. AS shown in FIG. 1A, spring portion 2 is connected to a middle portion of base portion 10'. Connector terminal 10 is integrally formed of a single sheet of plate as shown in the drawing, for example, tin-plated phosphor bronze plate (having a thickness of 0.25 mm).

Figure 2:
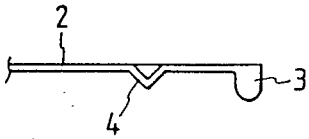
FIG. 2 is a side view showing spring portion 2 for explaining the projecting portion 4.

FIG. 2 is a side view of the spring portion 2 for illustrating projecting portion 4. In FIG. 2, the same portions as those in FIG. 1 are correspondingly referenced. Projecting portion 4 is formed in a manner so that the central portion of the spring portion 2 extends toward spring portion 2'. The top end of projecting portion 4 is made to abut on the rectangular conductor for the flat type electric wire in order to be spot-welded. The projecting portion 4 may be formed on either one of the spring portions (2 or 2') or on both the spring portions (2 and 2').

Figure 3:
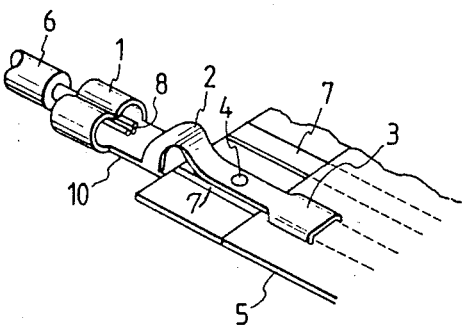
FIG. 3 is a perspective view showing the connection state of the connector terminal.

FIG. 3 is a perspective view showing the connector terminal according to the present invention connecting lead wire 6 to flat conductor 7. The same portions as those in FIG. 1 are correspondingly referenced in FIG. 3. Flat conductor 5 has a thickness of 0.35 mm and width of 3.0 mm, and comprises rectangular conductors 7, made for example of a tin-plated rolled copper foil which is 0.15 mm in thickness and 1.5 mm in width. Lead wire 6 comprises round conductor 8 having a core electric wire of, for example, 1.5 mm in diameter or stranded wires.

When the electric wires are connected to each other, the round conductor 8 (e.g., the core electric wire) is made to abut on the round conductor crimpable portion 1. Both ends of round conductor crimpable portion 1 are then crimped to connect the round conductor 8 to the round conductor crimpable portion 1, as shown in FIG. 3.

The connection of flat type electric wire 5 is made as follows: flat type electric wire 5 is stripped at either one or both of its opposing coated surfaces (one surface in the illustrated case) at the end portion of flat type electric wire 5, so that rectangular conductor 7 is exposed at that end portion. Each portion 2 and 2' of connector terminal 10 has a width corresponding to that of one rectangular conductor 7. Flat type electric wire 5 is inserted between spring portions 2 and 2' of connector terminal 10 in a manner so that the exposed portion of the rectangular conductor 7 is sandwiched between spring portions 2 and 2' and made to abut on projecting portion 4. In that position, force is applied to spring portions 2 and 2' so that they approach each other. The coating of flat type electric wire 5 is thus broken by the spring-portion crimpable portion 3, and the top end of spring-portion crimpable portion 3 is bent so as to crimp spring portion 2 against spring portion 2'. Thus, connector terminal 10 is pressingly attached to flat type electric wire 5 together with a part of the coating. At this time, spot welding or the application of solder is performed between the top end portion of projecting portion 4 and rectangular conductor 7 so as to securely connect connector terminal 10 and rectangular conductor 7 together.

When only one of the coated surfaces at the end portion of flat type electric wire 5 is stripped, projecting portion 4 need be provided only on one of the spring portions (spring portion 2 in the illustrated case) as shown in FIG. 1. In the case where both the coated surfaces of rectangular conductor 7 are stripped (e.g., upper and lower surfaces), projecting portion 4 may be provided on each of the spring portions (2 and 2') respectively so that both the projecting portions are spot-welded to the corresponding upper and lower surfaces of rectangular conductor 7.

Although spring-portion caulking portion 3 is formed on spring portion 2, it may alternatively be formed on the other spring portion 2'.

Figure 4:
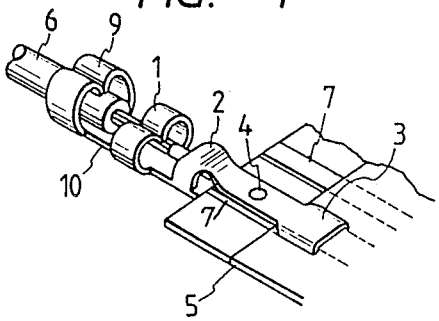
FIG. 4 is a perspective view showing the connection state of a variation of the connector terminal shown in FIG. 3.

FIG. 4 is a perspective view showing another embodiment of the connector terminal of the present invention. In the drawing, the same portions as those in FIG. 3 are referenced correspondingly in FIG. 4. Round electric wire caulking portion 9 is provided further outside round conductor caulking portion so as to pressingly fix the coated portion of round type electric wire 6. In this embodiment, round conductor 8 of lead wire 6 is pressingly fixed to connector terminal 10 not only by round conductor crimpable portion 1 but also by lead wire crimpable portion 9, so that not only bending between the coated portion and exposed conductor portion can be prevented but the conductor portion holding force against any wire-pulling forces on connector terminal 10 can be greatly improved.

Figure 5:
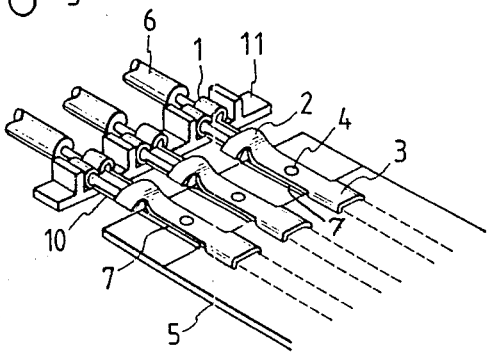
FIG. 5 is a perspective view showing the state in which a plurality of rectangular conductors are joined with a plurality of lead wires through a plurality of the connector terminals of FIG. 1, whereby the connector terminals are separated by a spacer for preventing shorting.

FIG. 5 is a perspective view showing another embodiment of the present invention in which a plurality of the aforementioned connector terminals 10 are connected to a flat type electric wire 5 having a plurality of rectangular conductors 7 arranged in parallel to each other. The same portions in FIG. 5 as those described in FIG. 3 are referenced correspondingly. In this embodiment, the whole system size is intended to be reduced to be as small a size as possible, so that the narrower the intervals between the conductors, the closer the connector terminals 10 adjacent to each other. In particular, flat type electric wire 5 is connected to lead wires 6 through respective connector terminals 10. Connector terminals 10 by nature may be easy to move and thus may be unstable: in the worst case, there is a possibility that the connector terminals 10 may touch each other, thereby causing a short-circuit.

Figure 6:
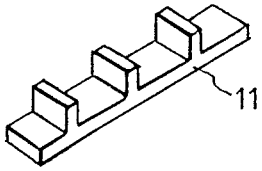
FIG. 6 is a perspective view showing the comb-like spacer.

In order to prevent a short-circuit from occurring, comblike spacer 11 is provided so as to separate the conductors as shown in FIG. 5, thereby eliminating the possibility of occurrence of a short circuit. Comb-like spacer 11, illustrated in FIG. 6, is made of an insulator such as nylon and has teeth formed at intervals corresponding to the intervals of connector terminals 10.

Figure 7:
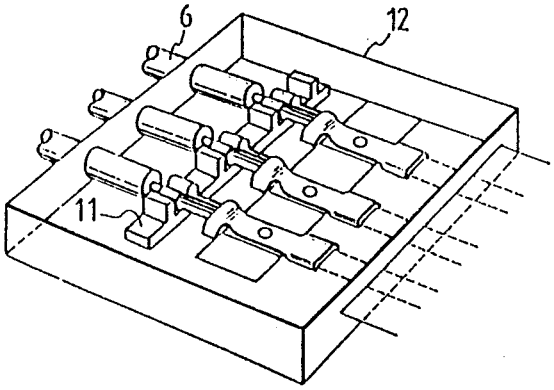
FIG. 7 is a transparent perspective view showing the embodiment of the present invention.

FIG. 7 is a transparent perspective view showing molding portion 12 around the connection obtained in FIG. 5. Molding portion 12 is formed, for example, with resin such as PBT, polyacetal, or the like, through a molding process.

Connector terminals 10, part of lead wires 6 and the coated connection end portion of flat type electric wire 5 are integrally molded by molding portion 12 in the form of, for example, a box. This integral molding by molding portion 12 produces an improvement in strength against pulling and bending forces, etc., exerted at the joint portions, and improves reliability in the connection. The resin molding is formed and shaped to be thick enough to sufficiently cover the whole of the connector terminals and the respective joint portions, thus preventing exposure to air, external agents, etc.

Figure 8:
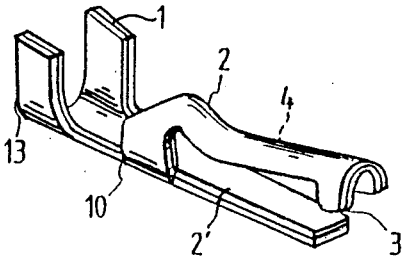
FIG. 8 is a perspective view of another connector terminal used in the present invention.
Figure 9:
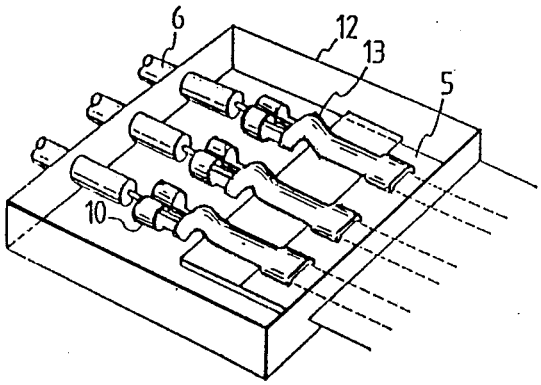
FIG. 9 is a transparent perspective view of another embodiment using the connector terminals of FIG. 8.

FIG. 8 is a perspective view of another connector terminal to be used according to the present invention, and FIG. 9 is a transparent perspective view of another embodiment using the connector terminals of FIG. 8. This embodiment is the same as the foregoing embodiment of the invention except that the outer side surface portions of the connector terminal, other than the surface portions which will be in contact with the round type electric wire and the flat type electric wire, are coated with insulator coating film 13. Thus, even if a plurality of connector terminals provided with the lead wires 6 and flat type electric wire 5 connected thereto are arranged side by side without using comb-like spacer 11, as shown in FIG. 9, a shortcircuit cannot occur between connector terminals 10 which are adjacent to each other.

A connector terminal coated with insulator coating film 13 in advance as shown in FIG. 8 may be used, or, alternatively, such a connector terminal as shown in FIG. 1 may be used so that the connector terminal is coated with an insulator such as epoxy or the like after connection has been made. Further, spot-welding can be carried out by removing the insulator coating film only at a portion thereof to which an electrode rod is to be applied for spot welding.

As described above, according to the present invention, the round conductors of lead wires are connected by crimping to the round conductor crimpable portions of respective connector terminals; and the rectangular conductors of a flat type electric wire are spot-welded with the projecting portions of the spring portions of the respective connector terminals. As a result, the lead wires and the flat type electric wire are joined through the respective connector terminals. The connector terminals are respectively arranged in the corresponding recess portions formed among the teeth of a comb-like spacer made of an insulator, and the whole of the joint portions including the coating end portions of the lead wires and the flat type electric wire are covered with resin and solidified in the form of a box through a molding or filling process. Accordingly, no short-circuit due to contact will occur between the connector terminals, and the connection between the lead wire and the flat type electric wire is made extremely compact and highly reliable.

The connector terminal according to the present invention has a further effect that reliable and stable connection can be maintained for a long time when the connector terminal is used for the connection of internal wiring in electronic equipment for home use or for industrial use in which lead wires and flat type electric wires coexist, particularly for use in cars.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. An apparatus for connecting a plurality of lead wires to a corresponding plurality of flat wires comprising:

a plurality of connector terminals, each connector terminal for connecting a first wire of said plurality of lead wires to a corresponding second wire of said plurality of flat wires, each connector terminal comprising:

a base portion having first and second ends, a first crimpable portion for securing said first wire to said first end of said base portion, a clasping portion for connecting said second wire to said second end of said base portion, said clasping portion comprising a first spring portion having a first end and a second end, said first end of said first spring portion being connected to a middle portion of said base portion, and a second crimpable portion disposed at said second end of said first spring portion for securing said first spring portion to said second end of said base portion, said second wire adapted to be disposed between said first spring portion and said second end of said base portion, and a projecting portion projecting from said connector terminal for contact with said second wire; and means for separating said connector terminals, said separating means for preventing a short circuit between the connector terminals.

2. An apparatus as recited in claim 1, wherein said first crimpable portion and said clasping portion are integrally formed with said base portion.

3. An apparatus as recited in claim 2, wherein each of said plurality of connector terminals is integrally formed of a single sheet of metal.

4. An apparatus as recited in claim 2, wherein said projecting portion receives solder for spot welding said projecting portion to said second wire.

5. An apparatus as recited in claim 4, wherein said projecting portion is disposed on said first spring portion.

6. A connector terminal as recited in claim 4, wherein said projecting portion is disposed on said second end of said base portion.

7. A connector terminal as recited in claim 2, wherein said second end of said base portion comprises a second spring portion.

8. An apparatus as recited in claim 1, further comprising molding means for encasing said plurality of connector terminals and said separating means.

9. An apparatus as recited in claim 8, wherein said molding means consists essentially of resin, thereby protecting said plurality of connector terminals from exposure to air or moisture.

10. A connector terminal having a first and second end for connecting a lead wire to a flat wire, comprising:

a base portion having first and second ends;

a first crimpable portion for securing said lead wire to said first end of said base portion;

a clasping portion for connecting said flat wire to said second end of said base portion, said clasping portion comprising a first spring portion having a first end and a second end, said first end of said first spring portion being connected to a middle portion of said base portion, and a second crimpable portion disposed at said second end of said first spring portion for securing said first spring portion to said second end of said base portion, said second wire being disposed between said first spring portion and said second end of said base portion;

a projecting portion projecting from said connector terminal toward said second wire; and an insulating layer on an outer surface of said connector terminal.

11. An apparatus as recited in claim 10, wherein said first crimpable portion and said clasping portion are integrally formed with said base portion.

12. An apparatus as recited in claim 11, wherein said connector terminal is integrally formed of a single sheet of metal.

13. An apparatus as recited in claim 11, wherein said projecting portion receives solder for spot welding said projecting portion to said flat wire.

14. An apparatus as recited in claim 13, wherein said projecting portion is disposed on said first spring portion.

15. A connector terminal as recited in claim 13, wherein said projecting portion is disposed on said second end of said base portion.

16. A connector terminal as recited in claim 11, wherein said second end of said base portion comprises a second spring portion.

17. An apparatus as recited in claim 10, further comprising molding means for encasing a plurality of said connector terminals.

18. An apparatus as recited in claim 17, wherein said molding means consists essentially of resin, thereby protecting said plurality of connector terminals from exposure to air or moisture.

19. An apparatus for connecting a plurality of lead wires to a corresponding plurality of flat wires comprising:

a plurality of connector terminals, each connector terminal for connecting a first wire of said plurality of lead wires to a corresponding second wire of said plurality of flat wires, each connector terminal having a first and second end, each connector terminal having an insulating layer on an outer surface, each connector terminal comprising:

a base portion having first and second end a first crimpable portion for securing said first wire to said first end of said base portion, a clasping portion for connecting said second wire to said second end of said base portion, said clasping portion comprising a first spring portion disposed above said second end of said base portion, and a second crimpable portion for securing said first spring portion to said second end of said base portion, said second wire adapted to be disposed between said first spring portion and said second end of said base portion, and a projecting portion projecting from said connector terminal for contact with said second wire; and molding means for encasing said plurality of connector terminals.

20. An apparatus as recited in claim 19, wherein said molding means consists essentially of resin, thereby protecting said plurality of connector terminals from exposure to air or moisture.

* * * * *